US011043757B2

(12) United States Patent
Hata et al.

(10) Patent No.: US 11,043,757 B2
(45) Date of Patent: Jun. 22, 2021

(54) ELECTRICAL CONNECTOR WITH FILLER SURROUNDING A WALL THAT SURROUNDS A CONTACT

(71) Applicants: KYOCERA CORPORATION, Kyoto (JP); TOYOTA JIDOSHA KABUSHIKI KAISHA, Aichi (JP)

(72) Inventors: Tetsuya Hata, Yokohama (JP); Shigeki Ohara, Yamato (JP); Hiroshi Kobayashi, Okazaki (JP); Motoya Hara, Nisshin (JP)

(73) Assignees: KYOCERA CORPORATION, Kyoto (JP); TOYOTA JIDOSHA KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/623,350

(22) PCT Filed: Jun. 4, 2018

(86) PCT No.: PCT/JP2018/021385
§ 371 (c)(1),
(2) Date: Dec. 16, 2019

(87) PCT Pub. No.: WO2018/235579
PCT Pub. Date: Dec. 27, 2018

(65) Prior Publication Data

US 2020/0176895 A1 Jun. 4, 2020

(30) Foreign Application Priority Data

Jun. 19, 2017 (JP) ..... JP2017-119917

(51) Int. Cl.
*H01R 4/2433* (2018.01)
*H01R 12/51* (2011.01)
(Continued)

(52) U.S. Cl.
CPC ..... *H01R 4/2433* (2013.01); *H01R 4/24* (2013.01); *H01R 4/2404* (2013.01);
(Continued)

(58) Field of Classification Search
CPC ..... H01R 4/2433; H01R 4/24; H01R 4/70; H01R 13/52; H01R 13/506;
(Continued)

(56) References Cited

U.S. PATENT DOCUMENTS 8,723,034 B2 5/2014 Xiao et al.
10,468,815 B2 11/2019 Hata et al.
(Continued)

FOREIGN PATENT DOCUMENTS

CN 202183394 U 4/2012
JP H05217610 A 8/1993
(Continued)

*Primary Examiner* — Abdullah A Riyami
*Assistant Examiner* — Justin M Kratt
(74) *Attorney, Agent, or Firm* — Duane Morris LLP

(57) ABSTRACT

Provided is a connector that can enhance the waterproof performance without reducing a pressure of a contact surface between fillers in a fitted state. A connector (10) according to the present disclosure includes a pair of fitting objects to be fitted to each other and a filler (70), a contact (50) and a wall (42) provided in the fitting objects. The wall (42) separates the filler (70) and the contact (50) after the fitting objects are fitted to each other.

12 Claims, 10 Drawing Sheets

(51) Int. Cl.

| | |
|---|---|
| *H01R 12/61* | (2011.01) |
| *H01R 4/2416* | (2018.01) |
| *H01R 4/24* | (2018.01) |
| *H01R 4/2466* | (2018.01) |
| *H01R 4/2412* | (2018.01) |
| *H01R 4/2491* | (2018.01) |
| *H01R 13/52* | (2006.01) |
| *H01R 4/70* | (2006.01) |
| *H01R 31/02* | (2006.01) |
| *H01R 13/50* | (2006.01) |
| *H01R 12/67* | (2011.01) |
| *H01R 4/2404* | (2018.01) |
| *H01R 4/2445* | (2018.01) |
| *H01R 13/58* | (2006.01) |
| *H01R 9/03* | (2006.01) |
| *H01R 13/506* | (2006.01) |
| *H01R 4/40* | (2006.01) |
| *H01R 43/00* | (2006.01) |

(52) U.S. Cl.
CPC ..... *H01R 4/2412* (2013.01); *H01R 4/2416* (2013.01); *H01R 4/2445* (2013.01); *H01R 4/2466* (2013.01); *H01R 4/2491* (2013.01); *H01R 4/40* (2013.01); *H01R 4/70* (2013.01); *H01R 9/031* (2013.01); *H01R 12/515* (2013.01); *H01R 12/616* (2013.01); *H01R 12/67* (2013.01); *H01R 12/675* (2013.01); *H01R 13/501* (2013.01); *H01R 13/506* (2013.01); *H01R 13/52* (2013.01); *H01R 13/521* (2013.01); *H01R 13/5202* (2013.01); *H01R 13/5208* (2013.01); *H01R 13/5216* (2013.01); *H01R 13/582* (2013.01); *H01R 13/5829* (2013.01); *H01R 31/02* (2013.01); *H01R 43/005* (2013.01)

(58) Field of Classification Search
CPC ..... H01R 13/5216; H01R 13/521; H01R 13/582; H01R 31/02; H01R 4/2445; H01R 12/675; H01R 4/2412; H01R 13/501; H01R 4/2404; H01R 9/031; H01R 12/67; H01R 12/515; H01R 12/616; H01R 13/5208; H01R 13/5829; H01R 43/005; H01R 4/2416; H01R 4/2466; H01R 4/2491; H01R 4/40; H01R 13/5202
USPC ..... 439/395, 404, 405, 409, 410
See application file for complete search history.

(56) References Cited

U.S. PATENT DOCUMENTS

| | | | |
|---|---|---|---|
| 2013/0008683 | A1 | 1/2013 | Xiao et al. |
| 2018/0277984 | A1 | 9/2018 | Hata et al. |

FOREIGN PATENT DOCUMENTS

| | | | | |
|---|---|---|---|---|
| JP | 3028988 | | | 2/2000 |
| JP | 3028988 | B2 | * | 4/2000 |
| JP | 2016184562 | A | | 10/2016 |
| WO | 2017/046982 | A1 | | 3/2017 |

* cited by examiner

ELECTRICAL CONNECTOR WITH FILLER SURROUNDING A WALL THAT SURROUNDS A CONTACT

CROSS REFERENCE TO RELATED APPLICATION

This application claims priority to and the benefit of Japanese Patent Application No. 2017-119917 filed on Jun. 19, 2017, the entire contents of which are incorporated herein by reference.

TECHNICAL FIELD

This disclosure relates to a connector.

BACKGROUND

In a conventionally known connector, a filler is placed in each of a pair of fitting objects to be fitted to each other to protect a contacting portion of a corresponding contact from foreign matter such as water or dust entering from outside when the fitting objects are fitted to each other.

For example, Patent Literature 1 (PTL 1) discloses a connector in which a drip-proof configuration is obtained by bringing a pair of elastic annular members of a grommet into close contact with each other when a cover and a body are fitted to each other.

CITATION LIST

Patent Literature

PTL 1: JP3028988 (B2)

SUMMARY

Technical Problem

In the above described connector, the pressure of the contact surface between fillers is reduced, which causes deterioration of the waterproof performance. The connector disclosed in PTL 1 does not have a waterproof structure and is provided without considering the above described problem.

It is therefore the object of this disclosure to provide a connector capable of enhancing the waterproof performance without reducing the pressure of the contact surface between fillers in a fitted state.

Solution to Problem

In order to solve the above described problem, a connector according to a first aspect includes:

a pair of fitting objects to be fitted to each other; and a filler, a contact and a wall provided in the fitting objects, wherein the wall separates the filler and the contact after the fitting objects are fitted to each other.

In the connector according to a second aspect, the wall may be disposed along an inner peripheral surface of the filler that surrounds the contact after the fitting objects are fitted to each other.

In the connector according to a third aspect, the wall may protrude to a fitting side beyond the filler after the fitting objects are fitted to each other.

In the connector according to a fourth aspect, the wall is provided to both of the pair of fitting objects, and one wall may be adjacent to another wall along a direction perpendicular to a fitting direction after the fitting objects are fitted to each other.

In the connector according to a fifth aspect, the wall may separate the filler and the contact before the fitting objects are fitted to each other.

In the connector according to a sixth aspect, the wall may be disposed along the inner peripheral surface of the filler that surrounds the contact before the fitting objects are fitted to each other.

In the connector according to a seventh aspect, the fitting objects may have a space for accommodating an excessive portion of the filler when the filler is excessive.

In the connector according to an eighth aspect, the space may be formed by a recess provided in an outer surface of the wall that faces the filler.

In the connector according to a ninth aspect, the pair of fitting objects are connected to each other by a connecting portion; the fitting objects hold a cable; and the contact may be included with electrically connected with the cable after the fitting objects are fitted to each other.

In the connector according to a tenth aspect, the contact has a press-contact groove; the fitting objects hold at least two of the cables; and the contact may electrically connect the cables to each other with core wires of the cables clamped by the press-contact groove after the fitting objects are fitted to each other,

Advantageous Effect

In a connector according to an embodiment of this disclosure, the waterproof performance can be enhanced without reducing a pressure of a contact surface between fillers in a fitted state.

DETAILED DESCRIPTION

An embodiment of this disclosure will be described below with reference to the accompanying drawings. In the following description, a front-rear direction, a right-left direction and an up-down direction are based on the directions of the arrows in the figures.

The configuration of a connector 10 loaded with no filler 70 will be mainly described below.

Figure 1:
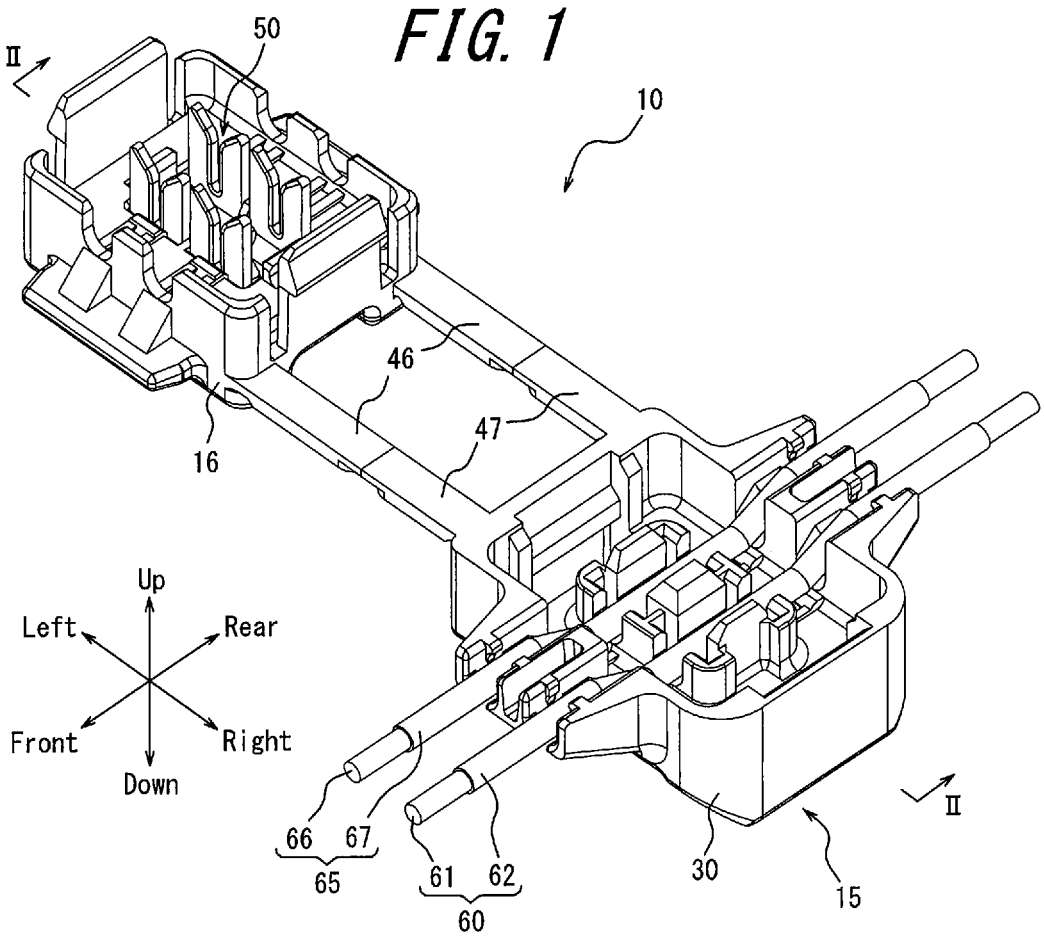
FIG. 1 is a perspective view of a connector, a first cable and a second cable according to an embodiment in which an insulating housing is in an expanded state.
Figure 2:
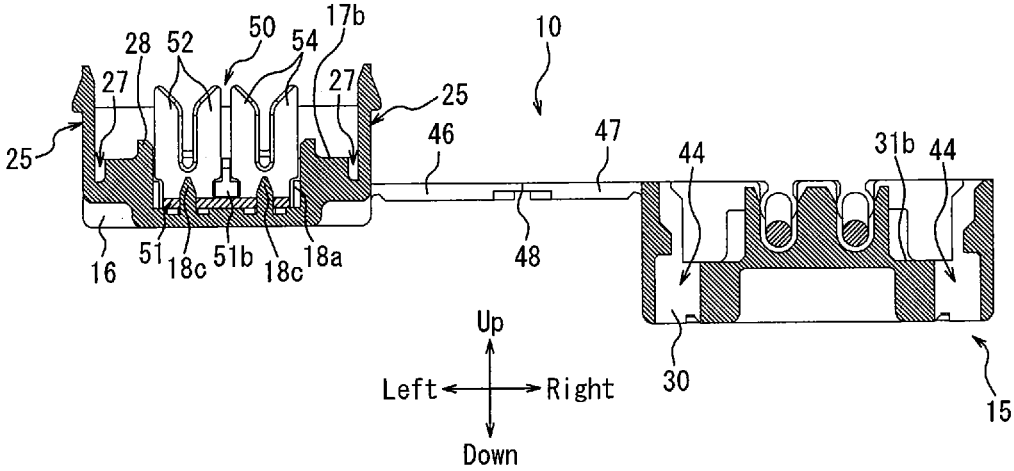
FIG. 2 is a cross-sectional view taken along arrows II-II in FIG. 1.

FIG. 1 is a perspective view of a connector 10, a first cable 60 and a second cable 65 according to an embodiment in which an insulating housing 15 is in an expanded state. FIG. 2 is a cross-sectional view taken along arrows II-II in FIG. 1. The connector 10 according to an embodiment includes an insulating housing 15 and a relay contact 50 (contact) as main elements.

The insulating housing 15 is obtained by, for example, molding a synthetic resin material having an insulating property. The insulating housing 15 includes a first split housing 16 (fitting object) and a second split housing 30 (fitting object). The insulating housing 15 includes a first connecting portion 46 and a second connecting portion 47 (connecting portion) acting as a coupling portion connecting the first split housing 16 and the second split housing 30. The insulating housing 15 includes the first split housing 16 and the second split housing 30, and the first connecting portion 46 and the second connecting portion 47, in an integrally molded manner.

Figure 3:
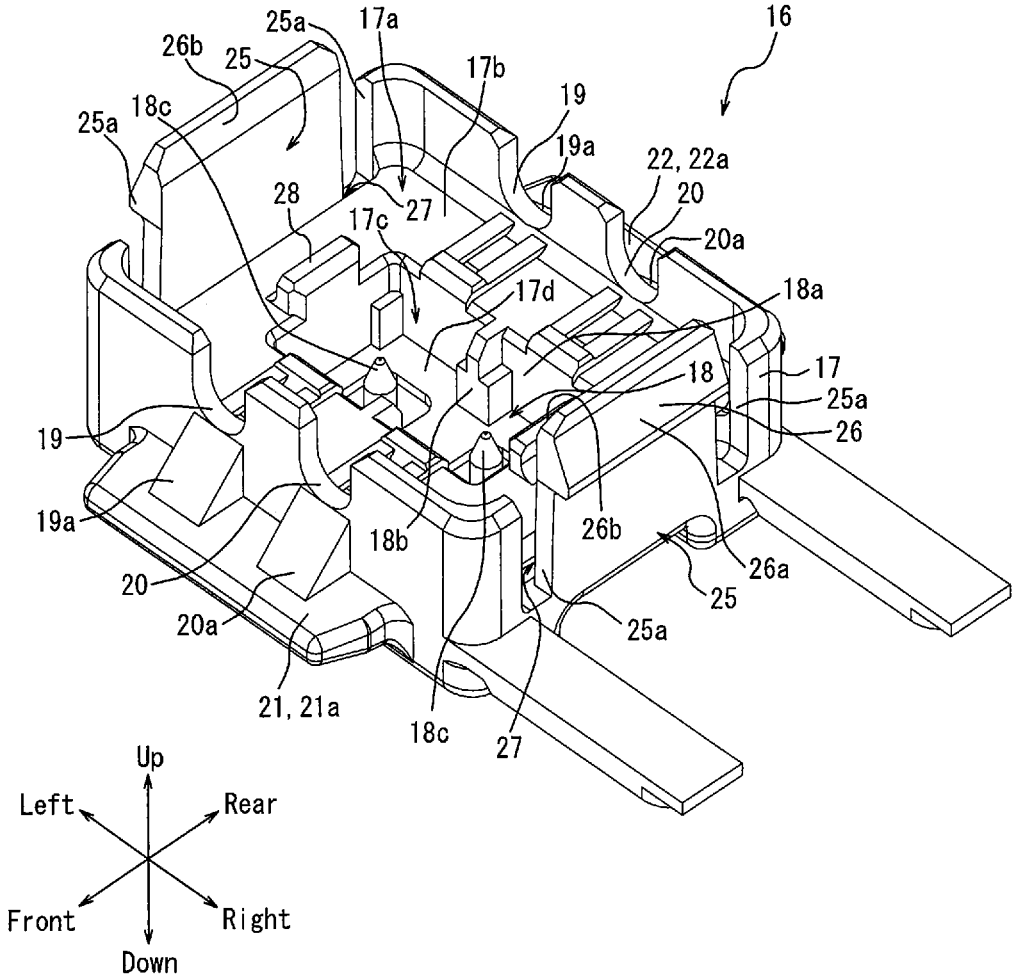
FIG. 3 is an enlarged perspective view illustrating a first split housing alone, omitting a relay contact.
Figure 4:
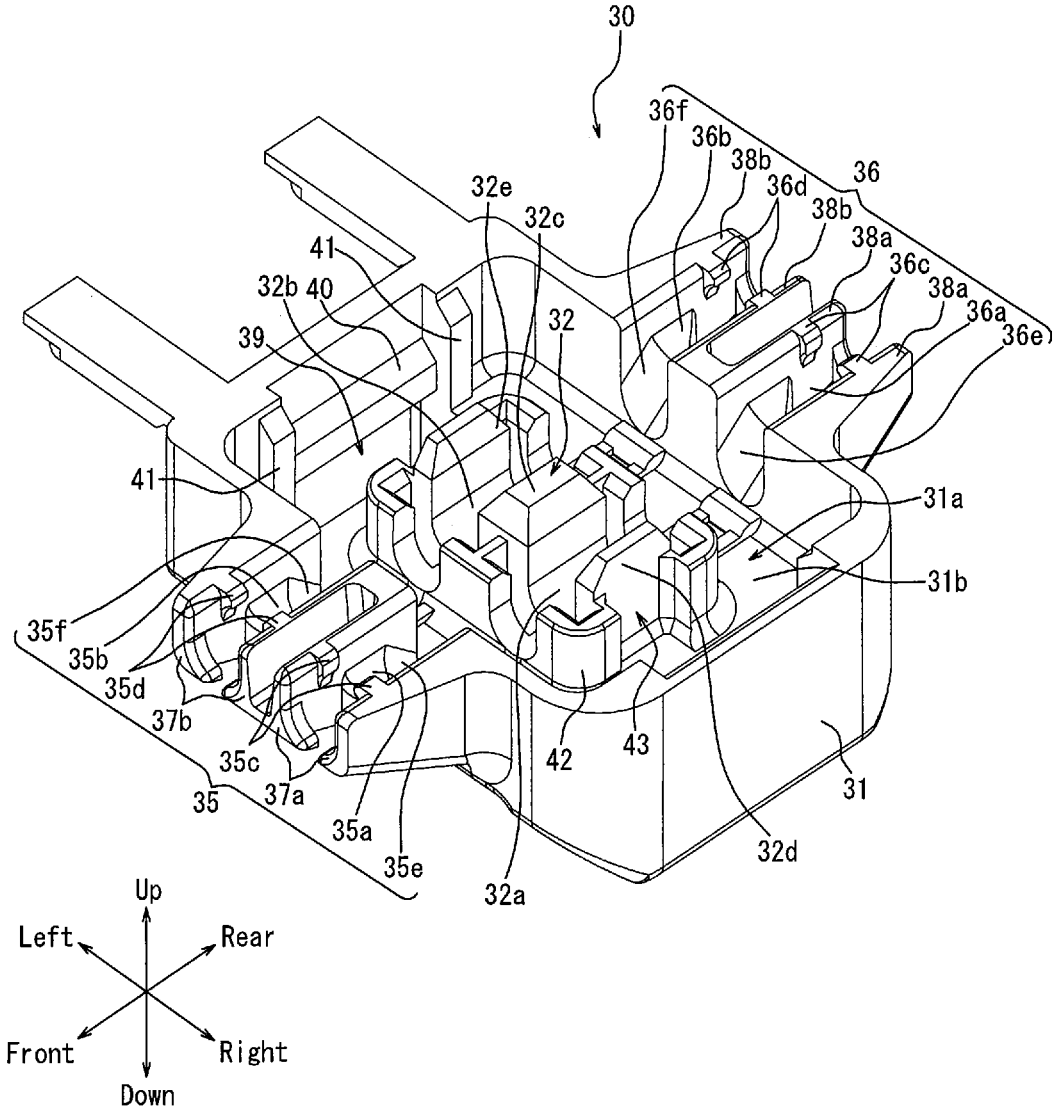
FIG. 4 is an enlarged perspective view illustrating a second split housing alone.
Figure 5:
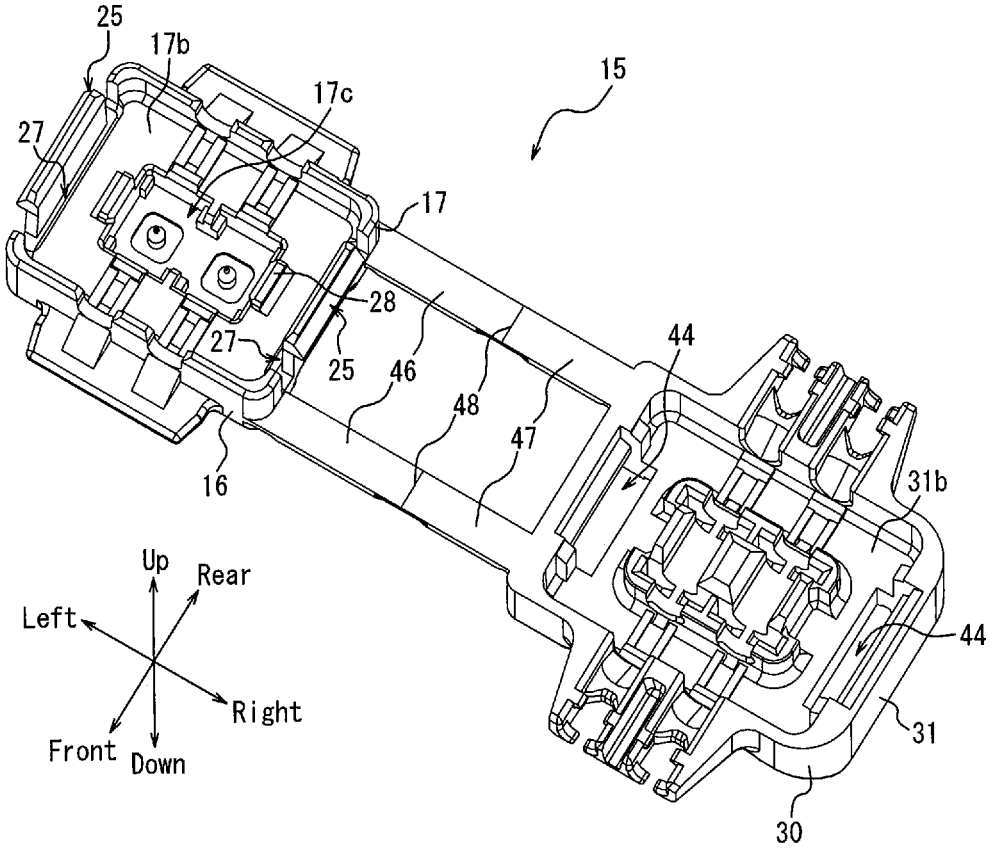
FIG. 5 is a perspective view illustrating the insulating housing in its entirety, omitting the relay contact.

FIG. 3 is an enlarged perspective view illustrating the first split housing 16 alone, omitting the relay contact 50, FIG. 4 is an enlarged perspective view illustrating the second split housing alone, and FIG. 5 is a perspective view illustrating the insulating housing in its entirety, omitting the relay contact 50.

The configuration of the first split housing 16 will be described in detail below with reference to FIG. 3.

An outer peripheral edge of one surface (an upper surface in FIG. 3) in a thickness-direction of the first split housing 16 is formed by an outer peripheral wall 17. In the first split housing 16, the inside of the outer peripheral wall 17 is configured as an inner peripheral recess 17*a* recessed stepwise from the top surface of the first split housing 16. The bottom surface of the inner peripheral recess 17*a* includes an inner peripheral first opposing surface 17*b* configured as a plane parallel to the top surface of the first split housing 16. The central portion located on the inner peripheral side of the inner peripheral first opposing surface 17*b* is configured as a first central recess 17*c* recessed stepwise from the inner peripheral first opposing surface 17*b*. The bottom surface of the first central recess 17*c* includes a first central opposing surface 17*d* configured as a plane parallel to the inner peripheral first opposing surface 17*b*. The first central recess 17*c* and the first central opposing surface 17*d* constitute a contact mounting groove 18. The contact mounting groove 18 includes a fixing portion 18*a* and a central projection 18*b*, which is located at the center of the fixing portion 18*a* with respect to the right-left direction and configured to narrow the front-rear direction width of the fixing portion 18*a* while separating the fixing portion 18*a* into a pair of portions in the right-left direction. Each of the bottom surfaces of the fixing portion 18*a* (the first central opposing surface 17*d*) is provided with a positioning protrusion 18*c* having a substantially columnar shape.

The outer peripheral wall 17 of the first split housing 16 includes a pair of first cable mounting grooves 19 configured as cutouts linearly arranged on the front and rear sides of one of the fixing portions 18*a*. The outer peripheral wall 17 of the first split housing 16 also includes a pair of second cable mounting grooves 20 configured as cutouts linearly arranged on the front and rear sides of the other fixing portion 18*a*. The second cable mounting groove 20 is in parallel with the first cable mounting groove 19. Each of the first cable mounting grooves 19 and each of the second cable mounting grooves 20 have a semi-circular shape in a plan view. On the front and rear surfaces of the outer peripheral wall 17 of the first split housing 16, a pair of inclined surfaces 19*a* is provided inclining outward in the downward direction from the bottoms of the pair of first cable mounting grooves 19. Similarly, on the front and rear surfaces of the outer peripheral wall 17 of the first split housing 16, a pair of inclined surfaces 20*a* is provided inclining outward in the downward direction from the bottoms of the pair of second cable mounting grooves 20. The front and rear surfaces of the outer peripheral wall 17 of the first split housing 16 are provided with cover portions 21 and 22, respectively. The cover portion 21 has a flat-plate shape extending in the front direction from under the inclined surfaces 19*a* and 20*a*, and the cover portion 22 has a flat-plate shape extending in the rear direction from under the inclined surfaces 19*a* and 20*a*. The opposing surface 21*a* of the cover portion 21 and the opposing surface 22*a* of the cover portion 22 are flush with the bottom of the inclined surface 19*a* and the bottom of the inclined surface 20*a*.

The right and left side surfaces of the outer peripheral wall 17 of the first split housing 16 are provided with a pair of first locking portions 25 having resiliency. A pair of recesses 25*a* is formed between each first locking portion 25 and each of the front and rear surfaces of the outer peripheral wall 17. Each first locking portion 25 is provided with a first locking protrusion 26 configured to protrude outward from the side surface of the first split housing 16. The first locking protrusions 26 extend in the front-rear direction. Each first locking protrusion 26 includes an inclined surface 26*a* that is inclined to the outside of the first split housing 16 in the downward direction. Each first locking portion 25 is provided with an inclined surface 26*b* that is formed on the top edge of the inner surface and inclined to the inside of the first split housing 16 in the downward direction.

As illustrated in FIGS. 2 and 5, each recess 27 is formed inside the lower edge of the first locking portion 25. Each recess 27 is recessed stepwise from the inner peripheral first opposing surface 17*b* along the lower edge of the first locking portion 25. Walls 28 each being adjacent to the right and the left sides of the first central recess 17*c* are provided to the center of the inner peripheral first opposing surface 17*b* in the front-rear direction.

The configuration of the second split housing 30 will be described in detail below with reference to FIG. 4.

An outer peripheral edge of one surface (an upper surface in FIG. 4) in a thickness-direction of the second split housing 30 is formed as a protrusion by an outer peripheral wall 31. In the second split housing 30, the inside of the outer peripheral wall 31 is configured as an inner peripheral recess 31*a* that is recessed stepwise from the top edge of the outer peripheral wall 31. A bottom surface of the inner peripheral recess 31*a* includes an inner peripheral second opposing surface 31*b* configured as a flat plane parallel to the top surface of the second split housing 30. The inner peripheral second opposing surface 31*b* is provided with a cable pressing protrusion 32 that includes a pair of a first pressing groove 32*a* and a second pressing groove 32*b* having U-shapes in cross-sections arranged in the right-left direction. The cable pressing protrusion 32 includes a central protrusion 32*c* and protrusions 32*d* and 32*e* on the right side and the left side, respectively, of the central protrusion 32*c*. The first pressing groove 32*a* is formed between the central protrusion 32*c* and the protrusion 32*d*. The second pressing groove 32*b* is formed between the central protrusion 32*c* and the protrusion 32*e*.

The second split housing 30 includes a cable supporting arm 35 protruding from the front surface of the second split housing 30 and a cable supporting arm 36 protruding from the rear surface. The top surface of the cable supporting arm 35 includes a first cable holding groove 35*a* and a second cable holding groove 35*b*, and the top surface of the cable supporting arm 36 includes a first cable holding groove 36*a* and a second cable holding groove 36*b*. The cable supporting arm 35 located on the front side is provided with a pair of protruding members 37*a* spaced apart from each other in the right-left direction in the front end portion of the first cable holding groove 35*a*, and the cable supporting arm 36 located on the rear side is provided with a pair of protruding members 38*a* spaced apart from each another in the right-left direction in the rear end portion of the first cable holding groove 36*a*. Similarly, the cable supporting arm 35 located on the front side is provided with a pair of protruding members 37*b* spaced apart from each other in the right-left direction in the front end portion of the second cable holding groove 35*b*, and the cable supporting arm 36 located on the rear side is provided with a pair of protruding members 38*b* spaced apart from each other in the right-left direction in the rear end portion of the second cable holding groove 36*b*. Each of the pair of protruding members 37*a*, the pair of protruding members 38*a*, the pair of protruding members 37*b* and the pair of protruding members 38*b*, particularly those located on the right and left outer sides of the cable supporting arms 35 and 36, is elastically bent in the right-left direction and the spacing from its adjacent protrusion is changeable. Each of the pair of protruding members 37*a* and 37*b* includes a pair of claws opposing each other formed at the lower front end. Also, each of the pair of protruding members 38*a* and 38*b* includes a pair of claws opposing each other formed at the lower rear end.

Each of the first cable holding grooves 35*a* and 36*a* and each of the second cable holding grooves 35*b* and 36*b* has a depth sufficient for insertion and retention (to accommodate) of the entire diameter of the first cable 60 and the second cable 65. The first cable holding grooves 35*a* and 36*a* include inclined surfaces 35*e* and 36*e*, respectively, which are inclined upward in the outward directions. When the first cable 60 is inserted into and held by the first cable holding grooves 35*a* and 36*a*, portions of the first cable 60 corresponding to the inclined surface 35*e* of the first cable holding groove 35*a* and the inclined surface 36*e* of the first cable holding groove 36*b* are inclined obliquely in the up-down direction. Similarly, the second cable holding grooves 35*b* and 36*b* include inclined surfaces 35*f* and 36*f*, respectively. The second cable 65 is inserted into and held by the second cable holding grooves 35*b* and 36*b* in a manner similar to the first cable 60.

A pair of retainer protrusions 35*c* is provided to the first cable holding groove 35*a* in the vicinity of a top opening of a front end portion (on the opposing surfaces provided with the pair of protruding members 37*a*) and a pair of retainer protrusions 36*c* is provided to the first cable holding groove 36*a* in the vicinity of a top opening of a rear end portion (on the opposing surfaces provided with the pair of protruding members 38*a*). Similarly, a pair of retainer protrusions 35*d* is provided to the second cable holding groove 35*b* in the vicinity of a top opening of a front end portion (on the opposing surfaces provided with the pair of protruding members 37*b*), and a pair of retainer protrusions 36*d* is provided to the second cable holding groove 36*b* in the vicinity of a top opening of a rear end portion (on the opposing surfaces provided with the pair of protruding members 38*b*). The retainer protrusions 35*c* and 36*c* allow insertion of the first cable 60 into the first cable holding grooves 35*a* and 36*a*, and the retainer protrusions 35*d* and 36*d* allow insertion of the second cable 65 into the second cable holding grooves 35*b* and 36*b*. At the time of the insertion, each of the pair of protruding members 37*a*, the pair of protruding members 38*a*, the pair of protruding members 37*b* and the pair of protruding members 38*b* is bent such that the gaps therebetween (i.e., the gap between the pair of retainer protrusions 35*c*, the gap between the pair of retainer protrusions 36*c*, the gap between the pair of retainer protrusions 35*d*, and the gap between the pair of retainer protrusions 36*d*) are widened in the right-left direction.

When the first cable 60 and the second cable 65 are inserted into the first cable holding grooves 35*a* and 36*a* and the second cable holding grooves 35*b* and 36*b*, respectively, each of the pair of retainer protrusions 35*c* and the pair of retainer protrusions 36*c* clamp the first cable 60, and each of the pair of retainer protrusions 35*d* and the pair of retainer protrusions 36*d* clamp the second cable 65. Each of the pair of protruding members 37*a*, the pair of protruding members 38*a*, the pair of protruding members 37*b* and the pair of protruding members 38*b* is elastically bent in directions which narrow the space therebetween in the right-left direction. Thus, the pair of protruding members 37*a* and the pair of protruding members 38*a* allow, in a resisting manner, a cable-extending-direction movement of the first cable 60 inserted into the first cable holding grooves 35*a* and 36*a*. Also, the pair of protruding members 37*b* and the pair of protruding members 38*b* allow, in a resisting manner, a cable-extending-direction movement of the second cable 65 inserted into the second cable holding grooves 35*b* and 36*b*. Further, the pair of protruding members 37*a* and the pair of protruding members 38*a* function as a stopper configured to resist a force acting to remove the first cable 60 from the first cable holding grooves 35*a* and 36*a* and inhibit easy removal of the first cable 60, and allow removal of the first cable 60 upon application of an external force of a certain strength or greater. Also, the pair of protruding members 37*b* and the pair of protruding members 38*b* function as a stopper configured to resist a force acting to remove the second cable 65 from the second cable holding grooves 35*b* and 36*b* and inhibit easy removal of the second cable 65, and allow removal of the second cable 65 upon application of an external force of a certain strength or greater. Such retaining actions as described above are maintained even when the second split housing 30 is flipped over (interchange of inside and outside).

The right and left side surfaces of the outer peripheral wall 31 of the second split housing 30 include a pair of second locking portions 39. The pair of second locking portions 39 is formed on the inner surface of the second split housing 30.

Each of the pair of second locking portions 39 includes a second locking protrusion 40 that protrudes inward from the side surface of the second split housing 30. Each of the second locking portions 39 includes a pair of projection walls 41 extending in the up-down direction at the front and rear ends of each of the second locking portions 39. Each of the second locking protrusions 40 has a substantially rectangular parallelepiped shape formed on the inner surface of the second split housing 30 and extends between the pair of projection walls 41. The second locking protrusions 40 extend in the front-rear direction.

A wall 42 including protrusions 32*d* and 32*e* is formed around the cable pressing protrusion 32. The wall 42 surrounds the first pressing groove 32*a*, the second pressing groove 32*b* and the central protrusion 32*c*. The wall 42 protrudes further to the fitting side than the positions where the protrusions 32*d* and 32*e* are formed. Notches configured to hold the first cable 60 with the first cable holding grooves 35*a* and 36*b* are formed each on the right side of the front and rear surfaces of the wall 42. Similarly, notches configured to hold the second cable 65 with the second cable holding grooves 35*b* and 36*b* are formed each on the left side of the front and rear surfaces of the wall 42. Recesses 43 (spaces) that are recessed stepwise inward are formed each on the outer surfaces in the right and left direction of the wall 42. The front-rear width of the recess 43 is slightly larger than that of the wall 28 of the first split housing 16.

As illustrated in FIGS. 2 and 5, penetrating portions 44 penetrating to the outer surface of the second split housing 30 along the up-down direction are formed each on the right and left ends of an inner peripheral second opposing surface 31*b*. Each penetrating portion 44 extends in the front-rear direction with a width slightly larger than the front-rear width of the first locking portion 25 of the first split housing 16.

As illustrated in FIG. 5, the first split housing 16 and the second split housing 30 are coupled via the pair of first connecting portions 46 that is arranged in the front-rear direction and linearly extends from the first split housing 16, a pair of second connecting portions 47 that is arranged in the front-rear direction and linearly extends from the second split housing 30, and a pair of fold-facilitating portions 48. The fold-facilitating portions 48 couple the pair of first connecting portions 46 and the pair of second connecting portions 47. The pair of first connecting portions 46 and the pair of second connecting portions 47 are flushed with each other in the expanded state.

As illustrated in FIGS. 2 and 5, the fold-facilitating portions 48 are thinner than the first connecting portion 46 and the second connecting portion 47 arranged in the front-rear direction. Each of the pair of first connecting portions 46 and the pair of second connecting portions 47 arranged in the front-rear direction can be (easily) folded at the fold-facilitating portions 48 that extend in the front-rear direction and serve as a folding line for valley-folding (i.e., in a folding manner to bring the first split housing 16 and the second split housing 30 close to each other) in FIG. 1, FIG. 5, and the like. The pair of first connecting portions 46 has flexural rigidity smaller than that of the pair of second connecting portions 47.

Each of the first split housing 16, the pair of first connecting portions 46, the fold-facilitating portions 48, the pair of second connecting portions 47, and the second split housing 30 has strength (rigidity) sufficient to autonomously maintain the expanded state illustrated in FIGS. 1 and 5.

Figure 6:
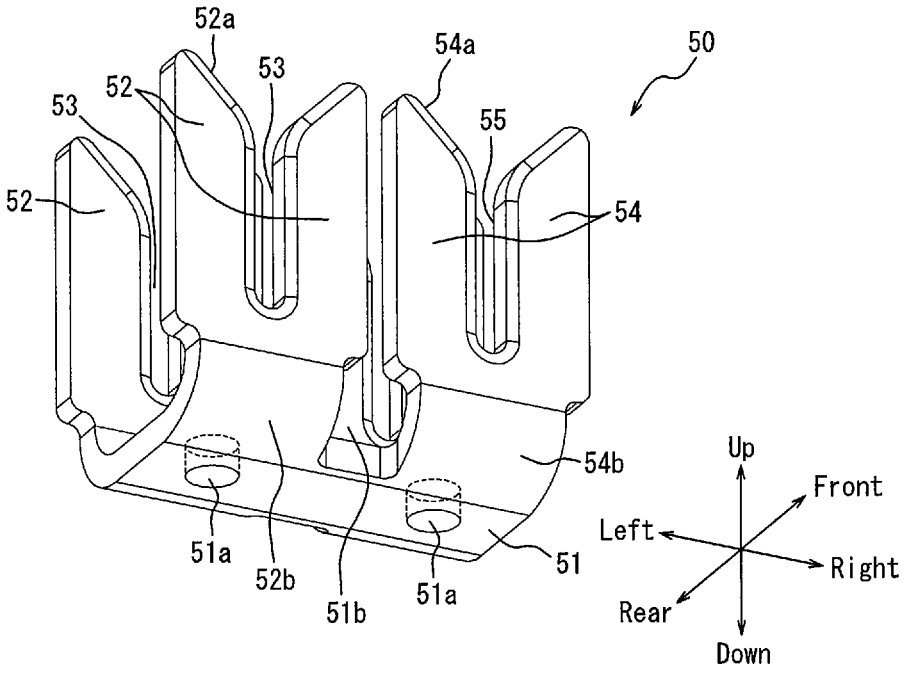
FIG. 6 is a perspective view illustrating the relay contact alone.

FIG. 6 is a perspective view illustrating the relay contact 50 alone. A configuration of the relay contact 50 will be described in detail with reference to FIG. 6.

The relay contact 50 is formed by processing of a thin plate made of a copper alloy (e.g., phosphor bronze, beryllium copper, or titanium copper) or Corson copper alloy into a shape as illustrated in the figure by using a progressive die (stamping). The relay contact 50 is plated with copper-tin alloy or tin (or gold) after nickel plate undercoating.

The relay contact 50 includes, in an integrated manner, a base 51 that has a plate-like shape and extends in the right-left direction, a pair of first cable press-contact members 52 each having a plate-like shape that protrudes from the front and rear edges on one side of the base 51 and extends in a direction perpendicular to the base 51, and a pair of second cable press-contact members 54 each having a plate-like shape that protrudes from the front and rear edges on the other side of the base 51 and extends in a direction perpendicular to the base 51. The base 51 includes a pair of positioning holes 51*a* having a circular shape in the right and left portions of the base 51. Each of the pair of first cable press-contact members 52 and each of the pair of second cable press-contact members 54 arranged in the front-rear direction includes a first press-contact groove 53 and a second press-contact groove 55, respectively, configured as slits linearly extending toward the base 51. Each of the pair of first press-contact grooves 53 includes, at the top opening thereof, a top end portion 52*a* having a substantially V-shape opening upward. Each of the pair of second press-contact grooves 55 includes, at the top opening thereof, a top end portion 54*a* having a substantially V-shape opening upward.

The pair of first cable press-contact members 52 and the pair of second cable press-contact members 54 arranged in the front-rear direction are coupled to the base 51 via narrow portions (neck portions) 52*b* and 54*b*, respectively. The spaces between the opposing edges of the pair of first cable press-contact members 52 and the pair of second cable press-contact members 54 arranged in the right-left direction are narrower than the spaces between the opposing edges of the narrow portions 52*b* and the narrow portions 54*b*. A space 51*b* is formed between the narrow portion 52*b* and the narrow portion 54*b*. No other members, such as an insulator, are provided between the pair of first cable press-contact members 52 and the pair of second cable press-contact members 54.

The relay contact 50 is included with electrically connected with the first cable 60 and the second cable 65 in a state in which the first split housing 16 and the second split housing 30 are fitted to each other. More specifically, when the first split housing 16 and the second split housing 30 are fitted to each other, the relay contact 50 cuts insulating sheaths 62 and 67 by a first press-contact groove 53 and a second press-contact groove 55, respectively, to allow the first cable 60 and the second cable 65 to be electrically connected to each other. When fitted to each other, the relay contact 50 allows the first press-contact groove 53 and the second press-contact groove 55 to clamp a core wire 61 and a core wire 66, respectively, to allow the first cable 60 and the second cable 65 to be electrically connected to each other.

The first cable 60 and the second cable 65 are respectively formed from core wires 61 and 66 (stranded wires or a single wire) made of a material (e.g., copper or aluminum) that has conductivity and flexibility, the core wires are respectively covered by sheaths 62 and 67 formed into a tubular shape and having flexibility and insulating properties. The first cable 60 is a cable originally provided in a wiring object (e.g., an automobile or the like) and configured to be connected to a power source of the wiring object. The second cable 65 is a cable additionally connected to the first cable 60. A (front) end of the second cable 65 is connected to an electronic device or an electrical device (e.g., a car navigation system).

Figure 7:
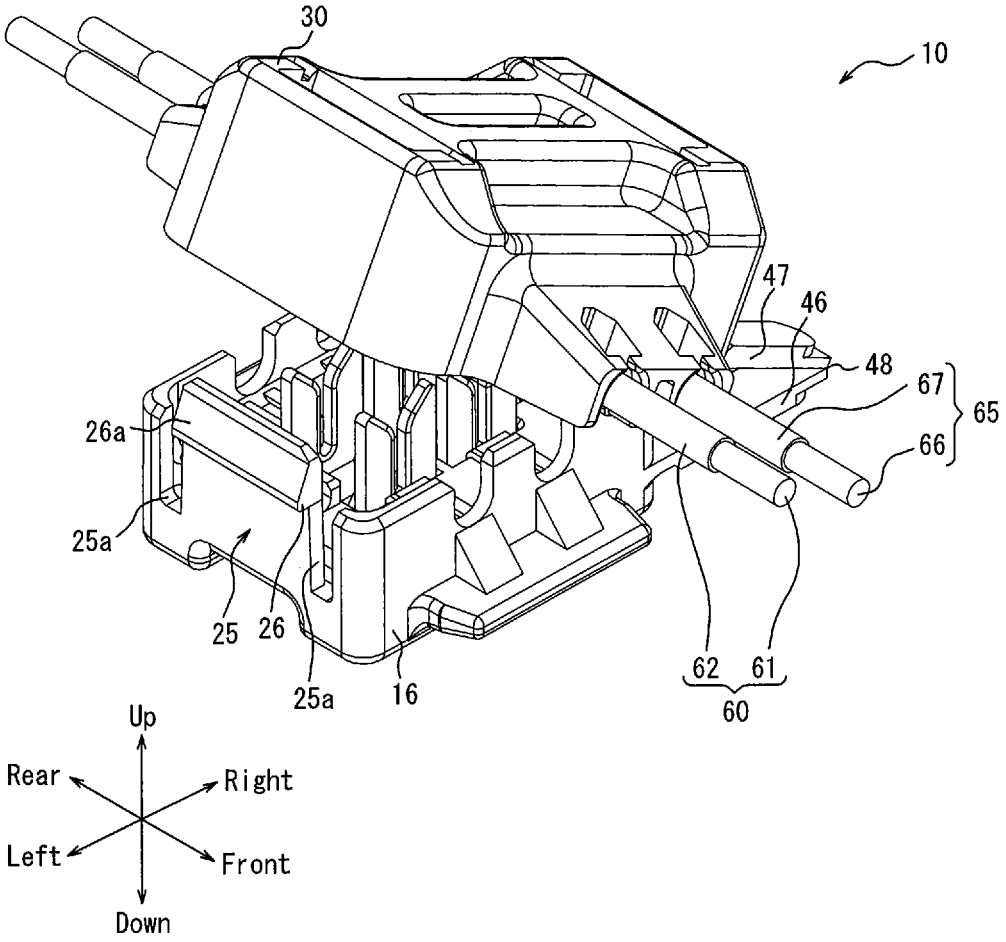
FIG. 7 is a perspective view illustrating the connector, the first cable and the second cable in transition of the insulating housing from an expanded state to a locked state.
Figure 8:
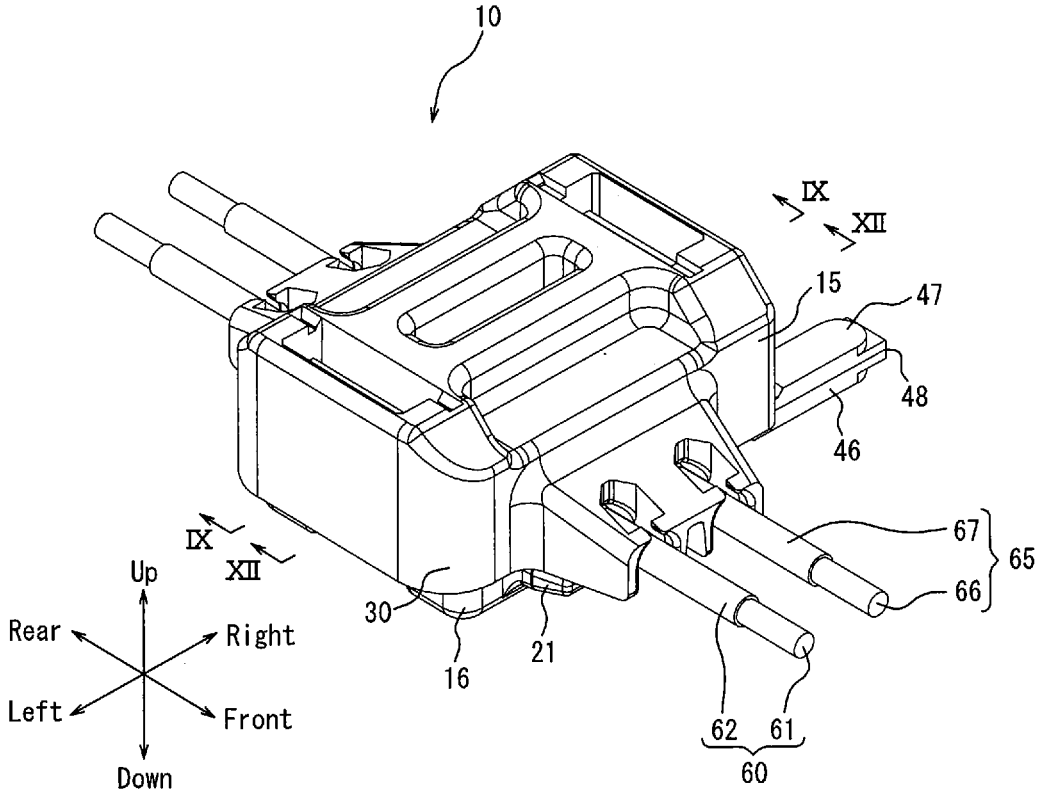
FIG. 8 is a perspective view illustrating the connector, the first cable and the second cable in which the insulating housing is in the locked state.
Figure 9:
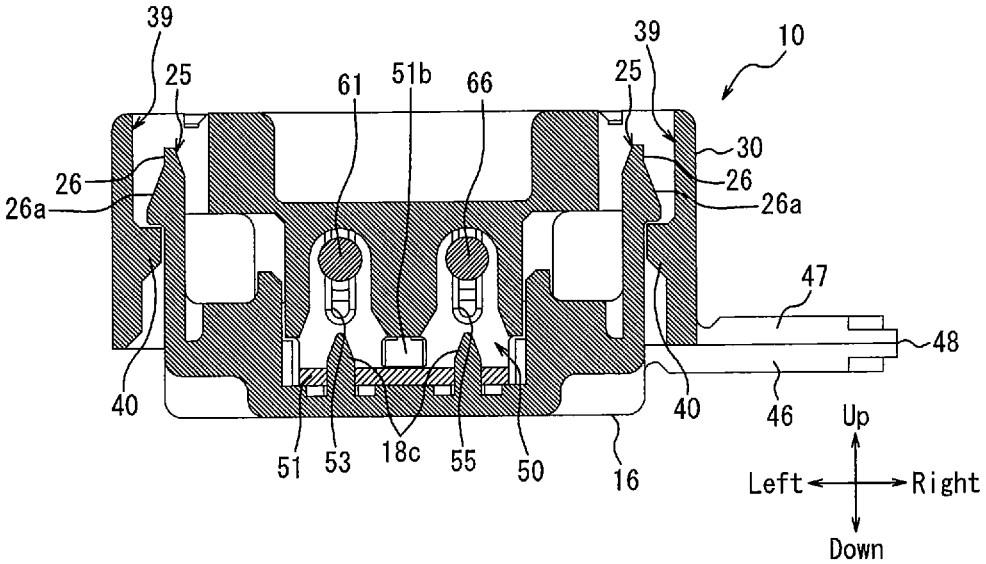
FIG. 9 is a cross-sectional view taken along arrows IX-IX in FIG. 8.

FIG. 7 is a perspective view illustrating the connector 10, the first cable 60 and the second cable 65 in transition of the insulating housing 15 from the expanded state to a locked state. FIG. 8 is a perspective view illustrating the connector 10, the first cable 60 and the second cable 65 when the insulating housing 15 is in the locked state. FIG. 9 is a cross-sectional view taken along arrows IX-IX in FIG. 8.

In order to assemble the connector 10 by integrating the insulating housing 15, the relay contact 50, the first cable 60 and the second cable 65 and electrically connecting the first cable 60 and the second cable 65, an assembling operator manually fits the lower portion of the relay contact 50 into the contact mounting groove 18 of the first split housing 16 in the expanded state illustrated in FIGS. 1 and 5. In particular, the base 51 is fitted to the bottom portion of the contact mounting groove 18 in such a manner that the space 51*b* accommodates the central projection 18*b*. Each of the half portions of the first cable press-contact members 52 close to the base 51 (the lower portions in FIG. 1 and FIG. 2) is fitted to a corresponding portion of the fixing portion 18*a*. Each of the half portions of the second cable press-contact members 54 close to the base 51 is fitted to a corresponding portion of the fixing portion 18*a*. Because the pair of positioning protrusions 18*c* of the first split housing 16 is fitted into the pair of positioning holes 51*a* of the base 51 (see FIG. 2 and FIG. 9), the relay contact 50 is positioned relative to the first split housing 16. When the relay contact 50 is mounted in the first split housing 16, the first press-contact grooves 53 arranged in the front-rear direction are located on the axis extending through the pair of first cable mounting grooves 19 arranged in the front-rear direction, and the second press-contact grooves 55 arranged in the front-rear direction are located on the axis extending through the pair of second cable mounting grooves 20 arranged in the front-rear direction.

The assembling operator manually pushes the first cable 60 and the second cable 65 in a manner overcoming the resistance of the retainer protrusions 35*c* and 36*c* arranged in the front-rear direction and the retainer projections 35*d* and 36*d* arranged in the front-rear direction (see FIG. 1). At the time of insertion, the pair of protruding members 37*a*, the pair of protruding members 38*a*, the pair of protruding members 37*b* and the pair of protruding members 38*b* are bent against the elastic force in such a manner as to widen the space between the pair of retainer protrusions 35*c*, the space between the pair of retainer protrusions 36*c*, the space between the pair of retainer protrusions 35*d* and the space between the pair of retainer protrusions 36*d*, respectively. When the first cable 60 and second cable 65 are pushed into the first cable holding grooves 35*a* and 36*a* and the second cable holding grooves 35*b* and 36*b*, respectively, the space between the retainer protrusions 35*c*, the space between the retainer protrusions 36*c*, the space between the retainer protrusions 35*d*, and the space between the retainer protrusions 36*d* are narrowed. In this manner, the first cable 60 is clamped between the bottom of the first cable holding grooves 35*a* and 36*a* and the retainer protrusions 35*c* and 36*c*, and the second cable 65 is clamped between the bottom of the second cable holding grooves 35*b* and 36*b* and the retainer protrusions 35*d* and 36*d*. This enables the first cable 60 and the second cable 65 to move in the cable extending direction in a resisting manner. Thus, positions of the first cable 60 and the second cable 65 can be adjusted in the extending directions thereof relative to the connector 10 in the expanded state illustrated in FIG. 1 and FIG. 2. Upon application of a force acting to remove the first cable 60 from the first cable holding grooves 35*a* and 36*a* or a force acting to remove the second cable 65 from the second cable holding grooves 35*b* and 36*b*, the corresponding one of first cable 60 and the second cable 65 receives a resisting force inhibiting the removal thereof. Therefore, even when the connector 10 is flipped upside down, the first cable 60 and the second cable 65 do not easily fall out of the first cable holding grooves 35*a* and 36*a* and the second cable holding grooves 35*b* and 36*b*, respectively. The first cable 60 and the second cable 65 can be removed from the first cable holding grooves 35*a* and 36*a* and the second cable holding grooves 35*b* and 36*b*, respectively, upon application of an urging force of a certain strength or greater. This facilitates replacement of the connector 10 and changes of the first cable 60 and the second cable 65 to be mounted in or dismounted from the connector 10.

In a state in which the first cable 60 and the second cable 65 are arranged in the right-left direction and fitted to the first cable holding grooves 35*a* and 36*a* and the second holding grooves 35*b* and 36*b*, respectively, the second split housing 30 (the pair of second connecting portions 47 arranged in the front-rear direction) is rotated toward the first split housing 16 (the pair of first connecting portions 46 arranged in the front-rear direction) in a manner pivoting around the fold-facilitating portions 48 arranged in the front-rear direction. This causes each of the second locking protrusions 40 of the first split housing 16 to contact a corresponding one of the inclined surfaces 26*a* of the first locking protrusions 26. When the second split housing 30 is further rotated, each of the second locking protrusions 40 slides downward on a corresponding one of the inclined surfaces 26*a*, and the first locking protrusions 26 are elastically deformed inward into the first split housing 16. The second pressing groove 32*b* of the cable pressing protrusion 32 located on the side close to the second connecting portion 47 slightly pushes the central portion of the second cable 65 toward the bottom (in the downward direction) of the second press-contact groove 55. This moves the central portion of the second cable 65 into the space between each of the pair of second cable press-contact members 54 arranged in the front-rear direction.

The assembling operator manually rotates the second split housing 30 further toward the first split housing 16 in a manner pivoting around the fold-facilitating portions 48 arranged in the front-rear direction. The first pressing groove 32*a* of the cable pressing protrusion 23 located on a side remote from the second connecting portions 47 pushes the central portion of the first cable 60 against the top end portions 52*a* of the first cable press-contact members 52 in the extending direction of the first press-contact grooves 53 or in a direction close thereto. In this manner, the first cable 60 is clamped by the top end portions 52*a* and the cable pressing protrusion 32.

After the first cable 60 and the second cable 65 are placed on the top end portion 52*a* and the top end portion 54*a*, respectively, of the relay contact 50, the first split housing 16 and the second split housing 30 are pushed together in substantially parallel directions bringing them close to each other by a generic tool (e.g., pliers), which is not illustrated. Each of the second locking protrusions 40 is engaged with a corresponding one of the first locking protrusions 26. Each of the projection walls 41 of the second locking portion 39 is fitted into a corresponding one of the recesses 25*a*. In this manner, the first split housing 16 is accommodated in the second split housing 30, and the first locking portions 25 and the second locking portions 39 are engaged with each other inside the first split housing 16 and the second split housing 30 fitted to each other.

The cable pressing protrusion 32 further pushes the central portions of the first cable 60 and the second cable 65 deep into (toward the bottoms of) the first press-contact groove 53 and the second press-contact groove 55, respectively. This moves the first cable 60 substantially to the central portions of the first press-contact grooves 53 from the top end portions 52*a*, and the second cable 65 substantially to the central portions of the second press-contact grooves 55 from the top end portions 54*a*. At this time, the first cable 60 and the second cable 65 are pressed by the first pressing groove 32*a* and the second pressing groove 32*b*, respectively, of the cable pressing protrusion 32 in directions substantially parallel to each other in the up-down direction (i.e., the extending directions of the first press-contact groove 53 and the second press-contact groove 55). Thus, the inner surfaces (right and left surfaces) of the first press-contact groove 53 cut through the right and left side portions of the sheath 62 of the first cable 60, and the inner surfaces (right and left surfaces) of the second press-contact grooves 55 cut through the right and left side portions of the sheath 67 of the second cable 65. In this manner, when the insulating housing 15 is held in a closed state, the inner surfaces (a pair of surfaces opposing each other) of the first press-contact grooves 53 evenly and reliably contact (press contact) both side portions of the core wire 61. Also, the inner surfaces (a pair of surfaces opposing each other) of the second press-contact grooves 55 evenly and reliably contact (clamp) both side portions of the core wire 66. Consequently, the core wire 61 of the first cable 60 and the core wire 66 of the second cable 65 are electrically connected to each other via the relay contact 50 within the connector 10.

Because the side portions of the core wire 61 and the side portions of the core wire 66 are not clamped in an excessively strong manner by the inner surfaces of the first press-contact grooves 53 and the inner surfaces of the second press-contact grooves 55, respectively, parts of the core wire 61 and the core wire 66 are not cut by the first press-contact grooves 53 and the second press-contact grooves 55, respectively. Thus, the core wires 61 and 66 maintain the respective mechanical strengths, thereby reducing the likelihood that the core wires 61 and 66 are completely severed by tensile forces applied to the first cable 60 and the second cable 65. Thus reliable contact between each of the first cable 60 and the second cable 65 and the relay contact 50 can be improved.

In a state in which the first split housing 16 and the second split housing 30 are closed (fitted to each other) and held (locked), the opposing surface 21*a* of the cover portion 21 of the first split housing 16 partially closes the openings (the top openings in FIG. 4) of the first cable holding groove 35*a* and the second cable holding groove 35*b*, and the opposing surface 22*a* of the cover portion 22 of the first split housing 16 partially closes the openings of the first cable holding groove 36*a* and the second cable holding groove 36*b*. The first cable 60 is clamped in the up-down direction by the pair of inclined surfaces 19*a* of the first split housing 16 and the corresponding inclined surfaces 35*e* and 36*e* of the second split housing 30. The second cable 65 is clamped in the up-down direction by the pair of inclined surfaces 20*a* of the first split housing 16 and the corresponding inclined surfaces 35*f* and 36*f* of the second split housing 30.

Hereinafter, the connector 10 in a state loaded with fillers 70 will be mainly described. The fillers 70 (a first filler 70*a* and a second filler 70*b*) are provided in the first split housing 16 and the second split housing 30, respectively. The first filler 70*a* and the second filler 70*b* may be combined together or may be stuck to each other to form a bonded surface when the first split housing 16 and the second split housing 30 are fitted to each other. The fillers 70 may be any appropriate material including a waterproof gel, a UV curing resin, or an adhesive that has a combining property or a sticking property.

Figure 10:
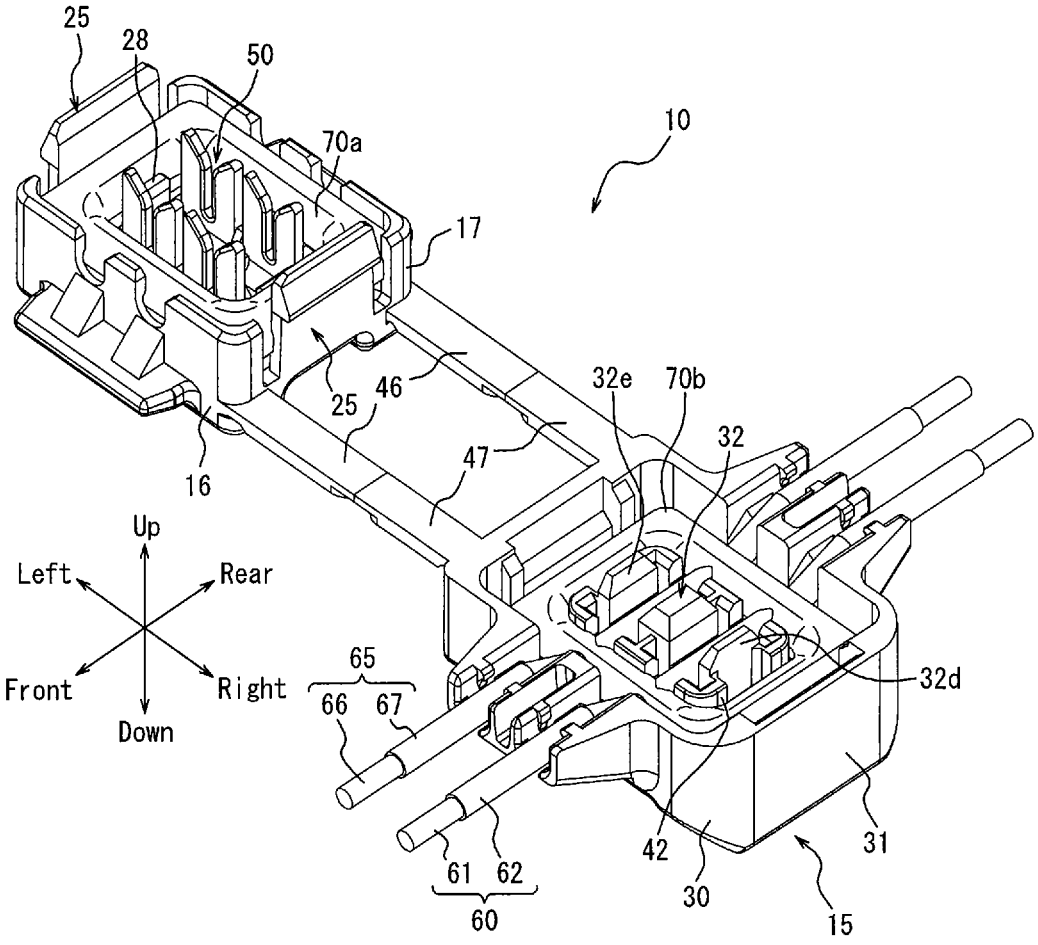
FIG. 10 is a perspective view of the insulating housing in the expanded state loaded with a filler.
Figure 11:
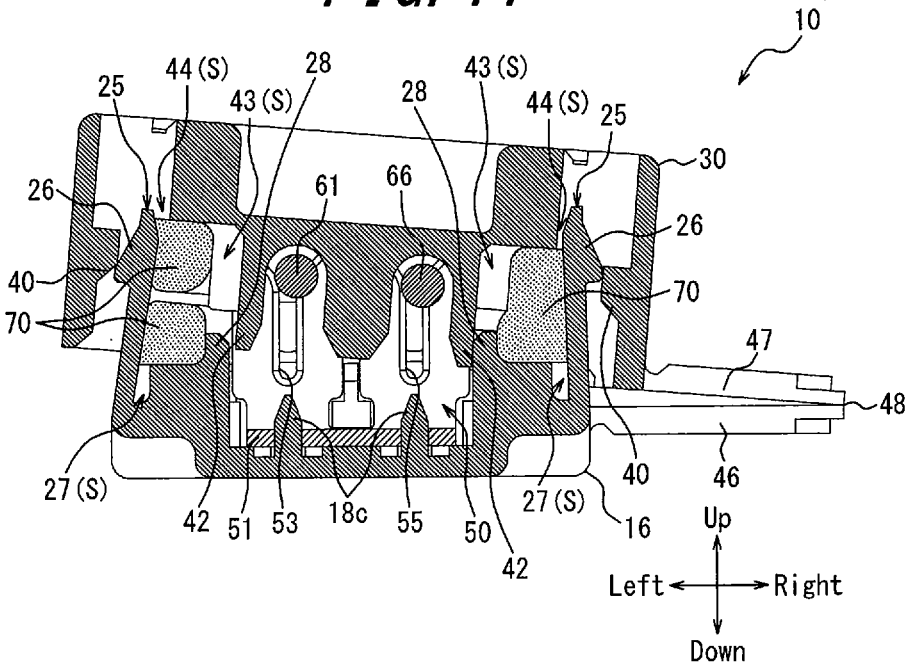
FIG. 11 is a cross-sectional view corresponding to FIG. 9 and illustrating the insulating housing loaded with a filler in transition from the expanded state to the locked state.
Figure 12:
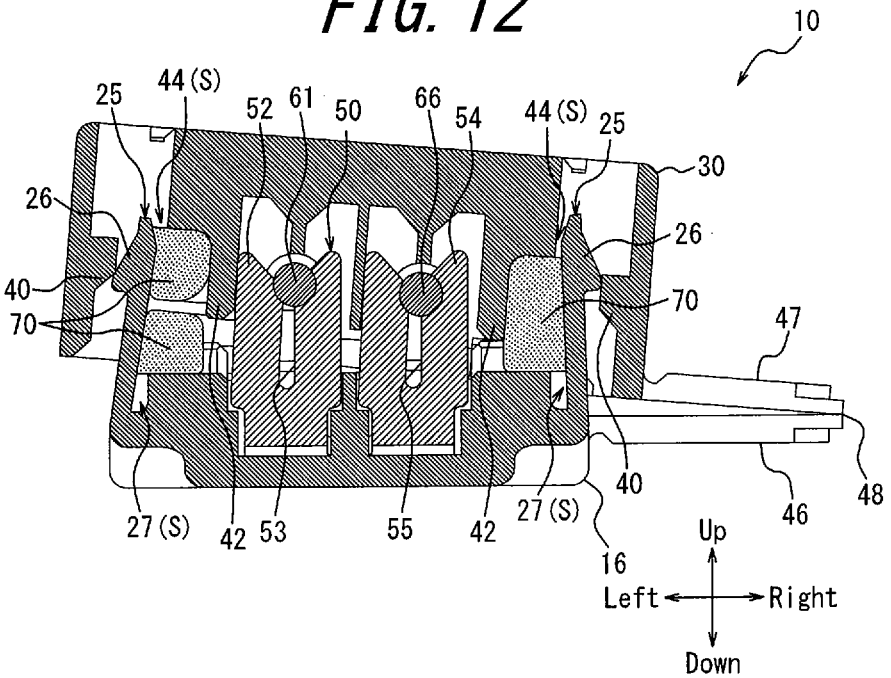
FIG. 12 is a cross-sectional view illustrating the insulating housing loaded with a filler in transition from the expanded state to the locked state taken along arrows XII-XII in FIG. 8.
Figure 13:
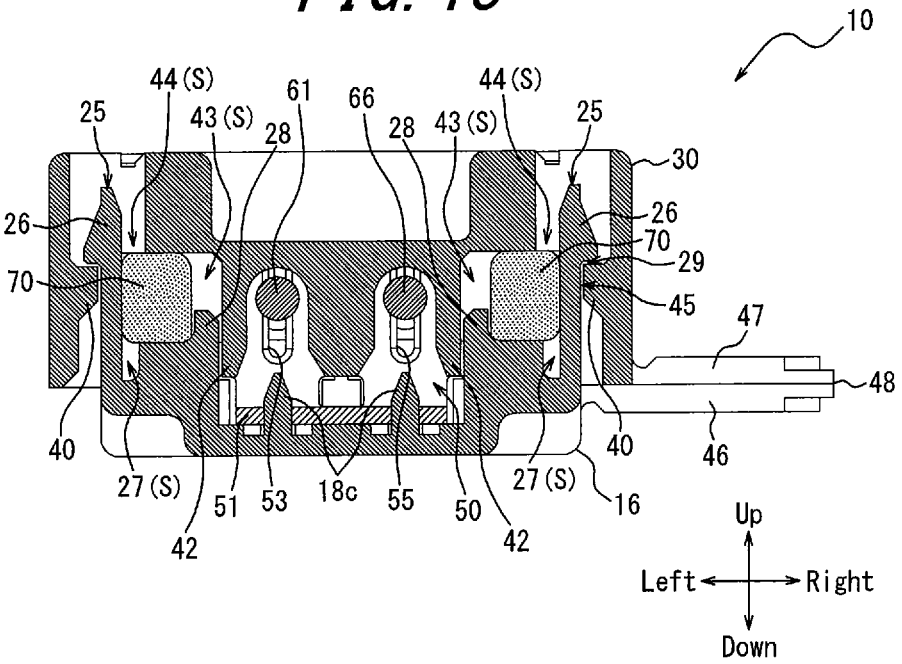
FIG. 13 is a cross-sectional view corresponding to FIG. 9 and illustrating the connector loaded with a filler in the locked state.
Figure 14:
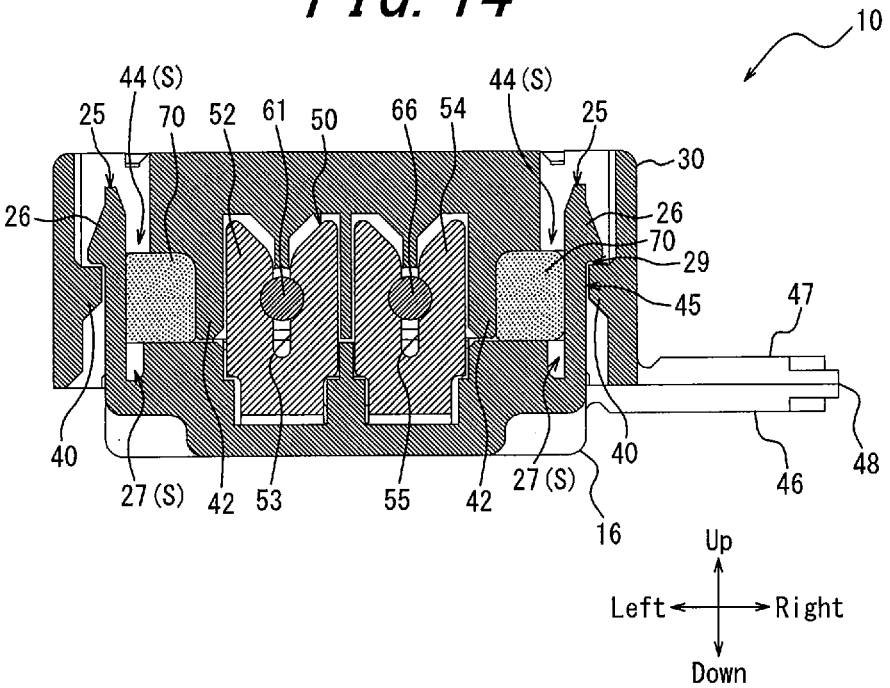
FIG. 14 is a cross-sectional view illustrating the connector loaded with a filler in the locked state taken along arrows XII-XII in FIG. 8

FIG. 10 is a perspective view illustrating the insulating housing 15 loaded with fillers 70 in the expanded state. FIG. 11 is a cross-sectional view corresponding go FIG. 9 and illustrating the insulating housing 15 loaded with fillers 70 in transition from the expanded state to the locked state. FIG. 12 is a cross-sectional view illustrating the insulating housing 15 loaded with fillers 70 in transition from the expanded state to the locked state taken along arrows XII-XII in FIG. 8. FIG. 13 is a cross-sectional view corresponding to FIG. 9 and illustrating the connector 10 loaded with fillers 70 in the locked state, and FIG. 14 is a cross-sectional view taken along arrows XII-XII in FIG. 8 illustrating the connector 10 loaded with fillers 70 in the locked state.

In an embodiment, the fillers 70 are placed on the inner peripheral first opposing surface 17*b* of the first split housing 16 and the inner peripheral second opposing surface 31*b* of the second split housing 30, as illustrated in FIG. 10.

The first filler 70*a* placed on the inner peripheral first opposing surface 17*b* of the first split housing 16 includes a bottom surface having a planar shape in substantial conformance with the inner peripheral first opposing surface 17*b*, and is formed such that it surrounds the relay contact 50. In this context, each wall 28 is disposed such that it is sandwiched between the relay contact 50 and the first filler 70*a*. The height of the first filler 70*a* is determined such that the first filler 70*a* and the second filler 70*b* are combined or stuck to each other when the first split housing 16 and the second split housing 30 are fitted to each other.

The second filler 70*b* placed on the inner peripheral second opposing surface 31*b* of the second split housing 30 includes a bottom surface having a planar shape in substantial conformance with the inner peripheral second opposing surface 31*b*, and is formed such that it surrounds the cable pressing protrusion 32. In this context, the wall 42 separates the first pressing groove 32*a*, the second pressing groove 32*b* and the central protrusion 32*c* from the second filler 70*b*. The wall 42 is disposed along the inner peripheral surface of the second filler 70*b* that surrounds the cable pressing protrusion 32. The wall 42 protrudes to the fitting side, that is, protrudes upward beyond the second filler 70*b*. The protrusions 32*d* and 32*e* are formed such that they protrude one step above the other portions of the wall 42. The height of the second filler 70*b* is determined such that the first filler 70*a* and the second filler 70*b* are combined or stuck to each other when the first split housing 16 and the second split housing 30 are fitted to each other.

When the connector 10 is transitioned to the locked state from the expanded state illustrated in FIG. 10, the entire interior of the first split housing 16 and the entire interior of the second split housing 30 fitted to each other are loaded with the fillers 70 as illustrated in FIGS. 13 and 14 after the state illustrated in FIGS. 11 and 12. In particular, when the first split housing 16 and the second split housing 30 are brought into the locked state, the fillers 70 closely contact the inner peripheral first opposing surface 17*b* and the inner peripheral second opposing surface 31*b* and surround the relay contact 50.

In the locked state, the first filler 70*a* and the second filler 70*b* are crushed to each other and are brought into a compressed state once, thus are closely contact to each other. In this context, when the fillers 70 are made of a material having a combining property, the first filler 70*a* and the second filler 70*b* are integrated through chemical reaction such as hydrogen bonding. When the fillers 70 are made of a material having a sticking property, the first filler 70*a* and the second filler 70*b* form a bonding surface such that they are stuck to each other. In this manner, the fillers 70 seal around the relay contact 50.

In this context, the wall 42 separates the relay contact 50 and the fillers 70. In other words, the wall 42 is disposed between the relay contact 50 and the fillers 70. The wall 42 is disposed along the inner peripheral surface of the fillers 70 that surrounds the relay contact 50 in a fitted state. The outer surface of the wall 42 faces the inner peripheral surface of the fillers 70. The outer surface of the wall 42 may come in contact with the inner peripheral surface of the fillers 70 (see FIG. 14). The wall 28 overlaps with the wall 42 in the right-left direction (see FIG. 13). The wall 28 and the wall 42 form a double structure after the fitting objects are fitted to each other. More specifically, the wall 28 is adjacent to the wall 42 in the direction perpendicular to the fitting direction, that is, along the right-left direction.

Each of the first split housing 16 and the second split housing 30 includes spaces S for accommodating excessive portions of the filler 70. The spaces S may be formed as three portions. The space S may be formed as a recess 43 provided in the outer surface of the wall 42 that faces the filler 70 (see FIG. 13). The space S may be formed as a penetrating portion 44 that penetrates the second split housing 30 in the fitting direction, that is, along the up-down direction (see FIGS. 13 and 14). The space S may be a recess 27 provided in a position that faces the penetrating portion 44 across the filler 70 after the fitting objects are fitted to each other. In this manner, penetrating portions 44 and recesses 27 are formed each along each of the pair of first locking portions 25 and are provided above and below the filler 70, respectively, when the first split housing 16 and the second split housing 30 are fitted to each other.

The first cable 60 and the second cable 65 extend outward from the relay contact 50 disposed inside the filler 70 in the locked state. The first cable 60 and the second cable 65 extend outward from the press-contact portion of the relay contact 50 along the front-rear direction.

The fillers 70 come in contact with the inner surfaces of the pair of first locking portions 25 of the first split housing 16. As illustrated in FIG. 13, each of the engaging surfaces 29 between the first locking protrusion 26 and the second locking protrusion 40 is located, with respect to the up-down direction thereof, within the width of the fillers 70 along the up-down direction. When the first split housing 16 and the second split housing 30 are fitted to each other, the surface of each second locking protrusion 40 comes in contact with the outer surface of each first locking portion 25. Each of abutment surfaces 45 thus formed is substantially parallel to the inner surface of the first locking portion 25 being in contact with the fillers 70.

With the fillers 70 configured in the above described manner, the connector 10 can effectively prevent foreign matter such as water or dust from entering from outside.

In the connector 10 according to an embodiment described above, the wall 42 prevents the fillers 70 compressed when fitted to each other from entering to the inside, which enhances the waterproof performance of the connector 10 without reducing the pressure of the contact surface between the fillers 70 in a fitted state. In the connector 10, entering of the fillers 70 into the relay contact 50 can be prevented after the fitting objects are fitted to each other, which enables the connector 10 to prevent poor contact of the relay contact 50 with core wires 61 and 66 of each cable.

In the connector 10, the wall 42 is disposed along the inner peripheral surface of the fillers 70, and thus the fillers 70 that surround the relay contact 50 are effectively prevented from entering thereto in all directions. In this manner the connector 10 produces the above-described related effects more prominently.

In the connector 10, a double structure formed by the wall 28 and the wall 42 enables corresponding portions to improve robustness as a wall. In this manner, in the connector 10, damage to the wall 28 and the wall 42 can be prevented even if a pressure toward the inside is applied when the fillers 70 are compressed.

As illustrated in FIG. 11, in the connector 10, the wall 42 largely protrudes to the fitting side beyond the second filler 70*b*, and thus the second filler 70*b* can be separated from the space inside before the first filler 70*a* and the second filler 70*b* come in contact to each other. In this manner, in the connector 10, the fillers 70 in a compressed state can be effectively prevented from entering to the inside at corresponding portions even in the middle of a fitting process. As illustrated in FIG. 12, the wall 42 protrudes to the fitting side beyond the second filler 70*b*, which enables the connector 10 to guide the first filler 70*a* in the first split housing 16 to the outside to allow the first filler 70*a* and the second filler 70*b* to be brought in contact with the filler 70 on the outside of the wall 42.

The connector 10 includes spaces S. The spaces allow the excessive portions of the fillers 70 to be absorbed and stored therein when fitted to each other. Therefore, the connector 10 can adjust the compressibility of the fillers 70 when fitted to each other. In other words, the connector 10 can reduce a difference in compressibility between the fillers 70. In the connector 10, spaces S are provided purposely at predetermined positions, which can prevent excessive portions of the fillers 70 from being spread to unintentional positions. In this manner, the connector 10 can suppress a decline of the fitting force and the pressure of the contact surface. The connector 10 can prevent the waterproof performance from being deteriorated. In this manner, in the connector 10, excessive portions of the fillers 70 do not influence the waterproof performance. In the connector 10, the fillers 70 can be prevented effectively from being entering into the relay contact 50 owing to the synergy between the wall 42 and the space S.

In the connector 10, the space S is formed by a recess 43, and thus can store therein the excessive portion of the filler 70 that is compressed and pushed out to the inside.

In the connector 10, the space S is formed by a penetrating portion 44, and thus can store therein the excessive portion of the fillers 70 that is compressed and pushed out to the outside. In the connector 10, the penetrating portion 44 penetrates upward, which allows the excessive portion of the filler 70 to be escaped to the outside. In the connector 10, the fillers 70 can be seen from the penetrating portion 44, which allows for easy visual confirmation of the volume of the fillers 70. Therefore, in the connector 10, the volume of the fillers 70 can be appropriately adjusted when manufacturing, which contributes to improvement of productivity.

In the connector 10, the space S is formed by a recess 27, and thus can store therein the excessive portion of the fillers 70 that is compressed and pushed out to the outside. In the connector 10, the excessive portion to be pushed out to the outside can be stored more effectively due to synergies between the recess 27 and the penetrating portion 44.

In the connector 10, the relay contact 50 is included with electrically connected with the cable, and thus the first cable 60 and the second cable 65 can be connected to each other in safety. In this manner, the reliability of the connector 10 as a product can be improved.

In the connector 10, cables extend to the outside from the relay contact 50 disposed inside the fillers 70, which allows the cables to be connected to other electronic devices while portions in contact with the relay contact 50 are protected from external foreign matters.

In the connector 10, the core wires 61 and 66 of the first cable 60 and the second cable 65 are clamped by the first press-contact groove 53 and the second press-contact groove 55, respectively, and are electrically connected. Thus the contact reliability thereof can be improved. In this manner, the connector 10 ensures electrical connection of the first cable 60 and the second cable 65.

It will be apparent to those skilled in the art that this disclosure can be realized in forms other than the embodiment described above, without departing from the spirit and the fundamental characteristics of the disclosure. Accordingly, the above described description is merely illustrative and not limiting in any manner. The scope of this disclosure is defined by the appended claims, not by the above described description. Among all modifications, those within a range of the equivalent to this disclosure shall be considered as being included in this disclosure.

In the above description, the relay contact 50 is mounted to the first split housing 16, but is not limited thereto, and the relay contact 50 may be mounted to the second split housing 30 or to both of the first split housing 16 and the second split housing 30.

In the above description, the first split housing 16 and the second split housing 30 are loaded with the first filler 70*a* and the second filler 70*b*, respectively, but is not limited thereto, and the connector 10 may be configured such that only one of the first split housing 16 and the second split housing 30 is loaded with a filler 70 as long as the connector 10 can obtain an appropriate waterproof property.

In the above description, the first split housing 16 includes the wall 28 and the second split housing 30 includes the wall 42, but is not limited thereto, and only one of the first split housing 16 and the second split housing 30 may have a configuration that corresponds to a wall. The wall 28 and the wall 42 may be exchanged, and the first split housing 16 may include the wall 42 and the second split housing 30 may include the wall 28. In this case, for example, the wall 42 may separate the first filler 70*a* and the relay contact 50 before the fitting objects are fitted to each other. Moreover, the wall 42 may be disposed along the inner peripheral surface of the first filler 70*a* that surrounds the relay contact 50 before the fitting objects are fitted to each other. This allows the connector 10 to produce the above described effects. In the above description, the wall 28 is formed at only a part around the relay contact 50 and a double structure is formed only by corresponding portions after the fitting objects are fitted to each other, but is not limited thereto. The wall 28 may be formed such that it surrounds the relay contact 50, and the wall 28 may form a double structure with the wall 42 all around the relay contact 50 after the fitting objects are fitted to each other. The wall 28 and the wall 42 may be formed into a shape tapered toward the fitting side to improve the guiding performance with respect to the corresponding filler 70.

In the above description, the wall 42 is disposed along the inner peripheral surface of the filler 70 that surrounds the relay contact 50 when fitted to each other, but is not limited thereto, and the wall 42 may be appropriately formed into a shape that corresponds to the way the fillers 70 are disposed inside the first split housing 16 and the second split housing 30.

The connector 10 may not include a space S as long as appropriate amounts of fillers 70 are precisely loaded therein and an excessive portion thereof does not occur.

In the above description, the space S is formed by a recess 43, a penetrating portion 44 and a recess 27, but is not limited thereto, and the space S may be formed into any manner as long as it accommodates an excessive portion of the fillers 70 and contributes to suppress degradation of the waterproof performance.

Although the relay contact 50 is configured to clamp the second cable 65, the relay contact 50 may be configured to crimp the second cable 65. In this case, the second cable 65 is connected in a crimped manner to the relay contact 50 in advance and, in this state, the relay contact 50 is mounted in the first split housing 16. In this embodiment, cable crimp terminals are formed in place of one of the pair of first press-contact grooves 53 and the pair of second press-contact grooves 55 of the relay contact 50. The second split housing 30 is provided with the cable supporting arm 35 or 36 corresponding to the remaining one of the press-contact grooves.

On the contrary, the connector 10 may connect three or more cables that are arranged in a direction orthogonal to or substantially orthogonal to the extending direction of the portions of the cables supported by the connector 10. In this case, a relay contact may include a set of three or more press-contact grooves (arranged in the right-left direction). A plurality of relay contacts may include the respective press-contact grooves, and at least one of the relay contacts includes two or more pairs of press-contact grooves, each of which is configured to clamp a cable (core wire).

REFERENCE SIGNS LIST

10 Connector
15 Insulating housing
16 First split housing (fitting object)
17 Outer peripheral wall
17*a* Inner peripheral recess
17*b* Inner peripheral first opposing surface
17*c* First central recess
17*d* First central opposing surface
18 Contact mounting groove
18*a* Fixing portion
18*b* Central projection
18*c* Positioning protrusion
19 First cable mounting groove
19*a* Inclined surface
20 Second cable mounting groove
20*a* Inclined surface
21, 22 Cover portion
21*a*, 22*a* Opposing surface
25 First locking portion
25*a* Recess
26 First locking protrusion
26*a*, 26*b* Inclined surface
27 Recess (space)

28 Wall
29 Engaging surface
30 Second split housing (fitting object)
31 Outer peripheral wall
31*a* Inner peripheral recess
31*b* Inner peripheral second opposing surface
32 Cable pressing protrusion
32*a* First pressing groove
32*b* Second pressing groove
32*c* Central protrusion
32*d*, 32*e* Protrusion
35, 36 Cable supporting arm
35*a*, 36*a* First cable holding groove
35*b*, 36*b* Second cable holding groove
35*c*, 36*c* Retainer protrusion
35*d*, 36*d* Retainer protrusion
35*e*, 36*e* Inclined surface
35*f*, 36*f* Inclined surface
37*a*, 37*b*, 38*a*, 38*b* Protruding member
39 Second locking portion
40 Second locking protrusion
41 Projection wall
42 Wall
43 Recess (space)
44 Penetrating portion (space)
45 Abutment surface
46 First connecting portion (connecting portion)
47 Second connecting portion (connecting portion)
48 Fold-facilitating portion
50 Relay contact (contact)
51 Base
51*a* Positioning hole
51*b* Space
52 First cable press-contact member
52*a* Top end portion
52*b* Narrow portion
53 First press-contact groove (press-contact groove)
54 Second cable press-contact member
54*a* Top end portion
54*b* Narrow portion
55 Second press-contact groove (press-contact groove)
60 First cable (cable)
61 Core wire
62 Sheath
65 Second cable (cable)
66 Core wire
67 Sheath
70 Filler
70*a* First filler
70*b* Second filler
S Space

The invention claimed is:

1. An electrical connector, comprising:

a first fitting object and a second fitting object to be fitted to each other;

a contact disposed in said first fitting object;

a filler disposed in said first fitting object and said second fitting object; and a wall formed in said second fitting object, wherein said wall is disposed inside said filler and, in a fitting state where said first fitting object and said second fitting object are fitted to each other, is disposed outside said contact and separates said filler and said contact, and wherein said first fitting object and said second fitting object include a space configured to accommodate an excessive portion of said filler.

2. The electrical connector according to claim 1, wherein said wall protrudes to a fitting side beyond said filler.

3. The electrical connector according to claim 1, wherein said wall is disposed outside said contact in a direction orthogonal to a direction in which said first fitting object and said second fitting object are fitted to each other.

4. The electrical connector according to claim 1, wherein said wall is disposed along an inner peripheral surface of said filler that surrounds said contact in said fitting state.

5. The electrical connector according to claim 1, wherein said wall is provided to both of said first fitting object and said second fitting object; and in said fitting state, one said wall is adjacent to another said wall along a direction perpendicular to a fitting direction.

6. The electrical connector according to claim 1, wherein said wall separates said filler and said contact in an expanded state where said first fitting object and said second fitting object are expanded.

7. The electrical connector according to claim 1, wherein said wall is disposed along an inner peripheral surface of said filler that surrounds said contact in an expanded state where said first fitting object and said second fitting object are expanded.

8. The electrical connector according to claim 1, wherein said wall is disposed around said contact in said fitting state.

9. The electrical connector according to claim 1, wherein said space is formed by a recess provided in an outer surface of said wall that faces said filler.

10. The electrical connector according to claim 1, wherein said first fitting object and said second fitting object are connected to each other by a connecting portion;

said second fitting object holds a cable; and said contact is electrically connected with said cable in said fitting state.

11. The electrical connector according to claim 10, wherein said contact includes a press-contact groove;

said second fitting object holds at least two said cables; and said contact electrically connects said cables to each other with core wires of said cables clamped by said press-contact groove in said fitting state.

12. The electrical connector according to claim 10, wherein said wall includes a notch configured to hold said cable.

* * * * *